US005752121A

United States Patent [19]

Earle et al.

[11] Patent Number: 5,752,121

[45] Date of Patent: May 12, 1998

[54] PHOTOGRAPHIC PROCESSING APPARATUS

[75] Inventors: Anthony Earle, Harrow; Leslie Robert Wells, Brentford, both of England

[73] Assignee: Eastman Kodak Company, Rochester, N.Y.

[21] Appl. No.: 713,305

[22] Filed: Sep. 13, 1996

[30] Foreign Application Priority Data

Sep. 27, 1995 [GB] United Kingdom ..... 9519709
May 9, 1996 [GB] United Kingdom ..... 9609640

[51] Int. Cl.[6] ..... G03D 5/00

[52] U.S. Cl. ..... 396/606; 396/627; 396/612

[58] Field of Search ..... 396/604, 606, 396/608, 618, 627, 935, 936; 15/77, 100, 102; 134/64 P, 64 R, 122 P, 122 R; 118/109, 245, 648, 660

[56] References Cited

U.S. PATENT DOCUMENTS

| | | | |
|---|---|---|---|
| 3,242,841 | 3/1966 | Goodall et al. | 396/606 |
| 3,299,791 | 1/1967 | Fukuda | 396/606 |
| 3,334,564 | 8/1967 | Kleinstra | 396/612 |
| 3,562,834 | 2/1971 | Stievenart et al. | 15/77 |
| 3,625,131 | 12/1971 | Puls | 396/606 |
| 4,294,533 | 10/1981 | Bratt et al. | 396/607 |
| 4,623,236 | 11/1986 | Stella | 396/606 |

FOREIGN PATENT DOCUMENTS

| | | |
|---|---|---|
| 0 558 875 | 9/1993 | European Pat. Off. . |
| 1135412 | 12/1968 | United Kingdom . |
| 1143702 | 2/1969 | United Kingdom . |

*Primary Examiner*—D. Rutledge
*Attorney, Agent, or Firm*—Frank Pincelli

[57] ABSTRACT

Described herein is processing apparatus in which processing solution can be applied in precise quantities to the sensitive surface of a photographic material. The apparatus includes at least one processing stage in which an endless belt is utilized to support the material and to guide it through the processing stage. Applicator devices are positioned above the surface of the belt for applying processing solution to the material. The applicator device can include an upper roller and two lower rollers confined in a cage, with the upper roller forcing the lower rollers apart inside the cage. A metering means is positioned to allow processing solution to flow onto the upper roller and then down onto lower rollers, with the lower rollers (44, 46) applying processing solution to the material.

10 Claims, 4 Drawing Sheets

PHOTOGRAPHIC PROCESSING APPARATUS

FIELD OF THE INVENTION

The present invention relates to photographic processing apparatus, and is more particularly, although not exclusively, concerned with the processing of photographic materials using small amounts of processing solution without the need for process control.

BACKGROUND OF THE INVENTION

It is known to use conveyor belts for supporting material to be processed or treated. Processing or treatment of the material is achieved by applying solutions to a surface of the material.

U.S. Pat. No. 3 625 131 discloses apparatus for automatically developing printing plates. At least two distribution rollers are positioned above a conveyor belt carrying the printing plates to be processed. The rollers are mounted for rotation in a direction opposite to the direction of travel of the conveyor belt and are axially slidable transversely of the belt to apply the developer uniformly over the surface of the printing plates.

U.S. Pat. No. 3 562 834 discloses apparatus for developing sheet material which carries a recording layer. The sheet material is applied to a wetted endless transport belt and processing solution is applied to the recording layer thereof by means of a rotatable rubbing drum in contact with the recording layer. The rubbing drum has a resilient porous peripheral surface having a peripheral speed which is substantially higher than the transport speed of the endless belt. Surplus processing solution is caught between a tray arranged beneath the rubbing drum and through which the lower stretch of the endless belt passes.

Apparatus as described above is also used for the application of processing solutions to a photosensitive surface of a photographic material.

Problem to be solved by the Invention

In conventional processing apparatus, process control is required to ensure that the activity of processing solutions is optimised. This requires replenishment of the processing chemicals as they are consumed by the process.

Normally, no account is taken of the density of the exposure so that a run of all dark or all light exposures could upset the chemical balance of the processing solution.

Evaporation and oxidation of the processing solution also needs to be accounted for and/or prevented.

Moreover, in processing apparatus in which large volumes of processing solutions are used, exhausted solution must be removed from the apparatus for disposal.

Furthermore, in apparatus where small volumes of processing solution are used at any one time, it is often difficult to provide uniform coverage of the material being processed with the processing solution.

SUMMARY OF THE INVENTION

It is therefore an object of the present invention to provide photographic processing apparatus which overcomes the problems mentioned above.

In accordance with one aspect of the present invention, there is provided apparatus for processing photographic material including at least one processing stage which comprises:

a support surface for supporting the material being processed;

transport means for transporting the material through the processing stage; and application means for applying processing solution to the material while it is in the processing stage, the application means comprising at least two roller members arranged above the support surface, an upper roller member being located above a corresponding lower roller member and in contact therewith;

characterized in that the application means further includes metering means for supplying processing solution in predetermined amounts to at least one roller member thereof;

and in that the roller members are freely mounted for rotation, each lower roller member being in contact with the support surface, at least in the absence of material to be processed, each roller member being rotated by contact with the support surface and/or movement of the photographic material through the processing stage.

Advantageously, the transport means comprises an endless belt supported by and between two rollers located in a substantially horizontal plane, the belt having an outer and an inner surface, the support surface comprising the outer surface of the endless belt.

Wiper means may be provided adjacent the application means for removing holding the material in even contact with the endless belt and for providing agitation of processing solution on the surface of the material.

It is preferred that the wiper means comprises a blade member wiper membrane which is held at one end against the outer surface of the endless belt by a spring element, movement of the endless belt drawing the blade member or wiper membrane out substantially horizontally.

Advantageously, the apparatus of the present invention is of particular use where it is desired to apply processing solutions which comprise redox amplification (RX) chemistry.

Advantageous Effect of the Invention

By this arrangement, small but sufficient amounts of processing solutions can be applied to photographic material while giving the appearance that the process is apparently dry, and providing uniform coverage of the material with the applied processing solution.

Moreover, no process control is required to ensure that the processing solutions have optimum activity as only sufficient processing solution is applied to the material being processed - fresh processing solution always being applied to the material being processed.

There is no need to take account of the exposure density given to the material as the chemical balance of the processing solution is not affected.

As small volumes of processing solution are used for processing the photographic material, there is little or no loss due to evaporation. The wiper means also assists with the prevention of evaporation and also helps to compensate for an endless belt which is not entirely level by forcing the material there against.

Furthermore, there is exhausted processing solution to dispose of.

BRIEF DESCRIPTION OF THE DRAWINGS

For a better understanding of the present invention, reference will now be made, by way of example only, to the accompanying drawings in which.

DETAILED DESCRIPTION OF THE INVENTION

Although the present invention is described with reference to photographic processing apparatus for processing photographic material having a sensitised surface, it will be readily appreciated that it can be utilized in any situation where it is desired to apply a solution to a surface carried by a conveyor belt.

Furthermore, the present invention is not limited to use in a photographic processor, but may form part of a system comprising an exposure station where photosensitive material is given an imagewise exposure, a processing station where the exposed material is processed, and a drying station where the processed material is dried before being delivered to a consumer.

Figure 1:
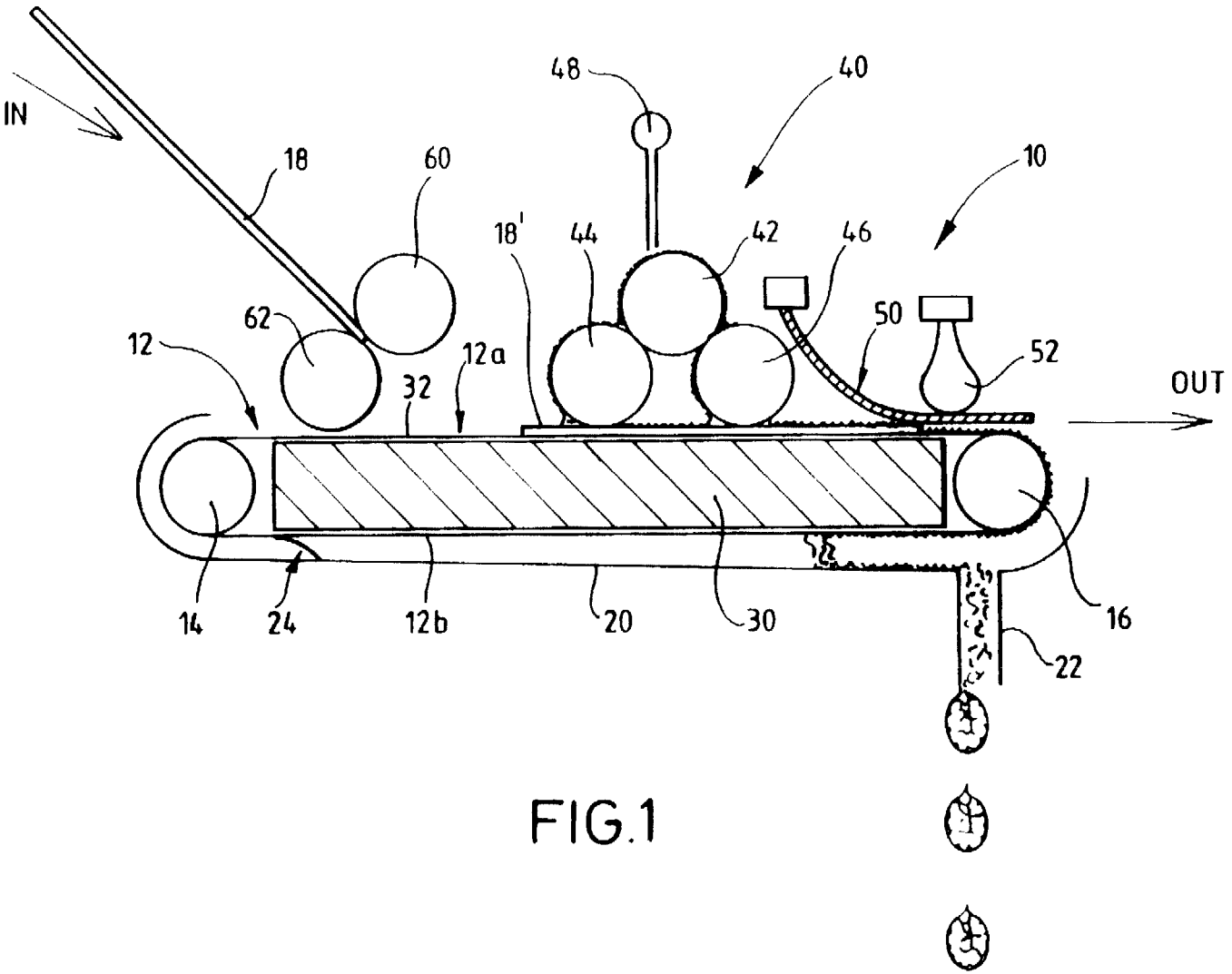
FIG. 1 is a schematic side elevation of a photographic processing stage in accordance with the present invention.

Referring initially to FIG. 1, a processing stage 10 of a photographic processor is shown. The processing stage 10 comprises an endless conveyor belt 12 mounted on two spaced apart rollers 14, 16 as shown. Portions 12*a*, 12*b* of the belt 12 between the rollers 14, 16 lie in a substantially horizontal plane, portion 12*a* being the upper portion on which material 18, 18' to be processed is located. At least one of the rollers 14, 16 is connected to a motor (not shown) so that drive is imparted to the belt 12. It will be readily appreciated that FIG. 1 illustrates the position of the belt 12 at a given instant in time, and that portions 12*a*, 12*b* will comprise different portions of the belt 12 at different instants in time.

A tray 20 surrounds the conveyor belt 12 to collect any processing solution which is transported round therewith. The tray 20 has a drain 22 through which the processing solution can be removed. A wiper blade 24 is provided in the tray 20 for making contact with the lower portion 12*b* of the belt 12. The wiper blade 24 removes excess processing solution from the surface of the belt 12 as it is transported by rollers 14, 16. The wiper blade 24 is located within the tray 20 by any suitable means (not shown).

A heating block 30 is positioned between rollers 14, 16 and upper portion 32 makes contact with portion 12*a* of the conveyor belt 12. Hot water (not shown) is fed into the block 30 to heat it to a suitable temperature for processing, by any suitable arrangement of pipes (not shown). Heat from the block 30 is transferred to the material 18' via upper portion 32 of the block 30 and upper portion 12*a* of the belt 12 (which as described above, will be constantly changing as the belt 12 is driven by the rollers 14, 16).

Located above the belt 12 is an applicator arrangement shown generally as 40. The applicator arrangement comprises three rollers 42, 44, 46 which are rotatably mounted and positioned to lie above portion 12*a* of the belt 12, lower rollers 44, 46 making contact with the portion 12*a*. Roller 42 is located above rollers 44, 46 and is in contact with both rollers 44, 46. There is no drive provided to rollers 42, 44, 46 —rotation of the rollers 42, 44, 46 being effected through contact of the lower rollers 44, 46 with portion 12*a* of the belt 12 and the material 18 as it is transported by the belt 12. This will be described in more detail with reference to FIG. 2.

The applicator arrangement 40 also includes a metering device 48 for providing predetermined amounts of a processing solution to upper roller 42, which in turn, transfers the processing solution to lower rollers 44, 46 and onto material 18 and belt 12. The metering device 48 is connected to a reservoir (not shown) and meters out exact quantities of processing solution which are similar to deep tank replenishment levels. This can be effected using metering pumps as is generally known.

Wiper blade 50 is located downstream of the applicator arrangement 40 for providing agitation of the processing solution on the surface of the material 18. The blade 50 is held against the belt 12 and material 18 by means of a spring element 52. The wiper blade 50 also lessens the effects of having a processing stage which is not completely level and prevents evaporation of the processing solution.

Material 18 to be processed enters the processing stage 10 by means of inlet roller pair 60, 62 which is driven at substantially the same speed as the conveyor belt 12. The material 18 is retained on upper portion 12*a* of the belt 12 due to surface tension, the belt 12 being wetted with processing solution from the applicator means or by means of a separate application of water or other suitable liquid (not shown).

As shown in FIG. 1, one sheet of material 18 is about to pass through inlet roller pair 60, 62 and another sheet 18' is passing under the applicator means 40.

Figure 2:
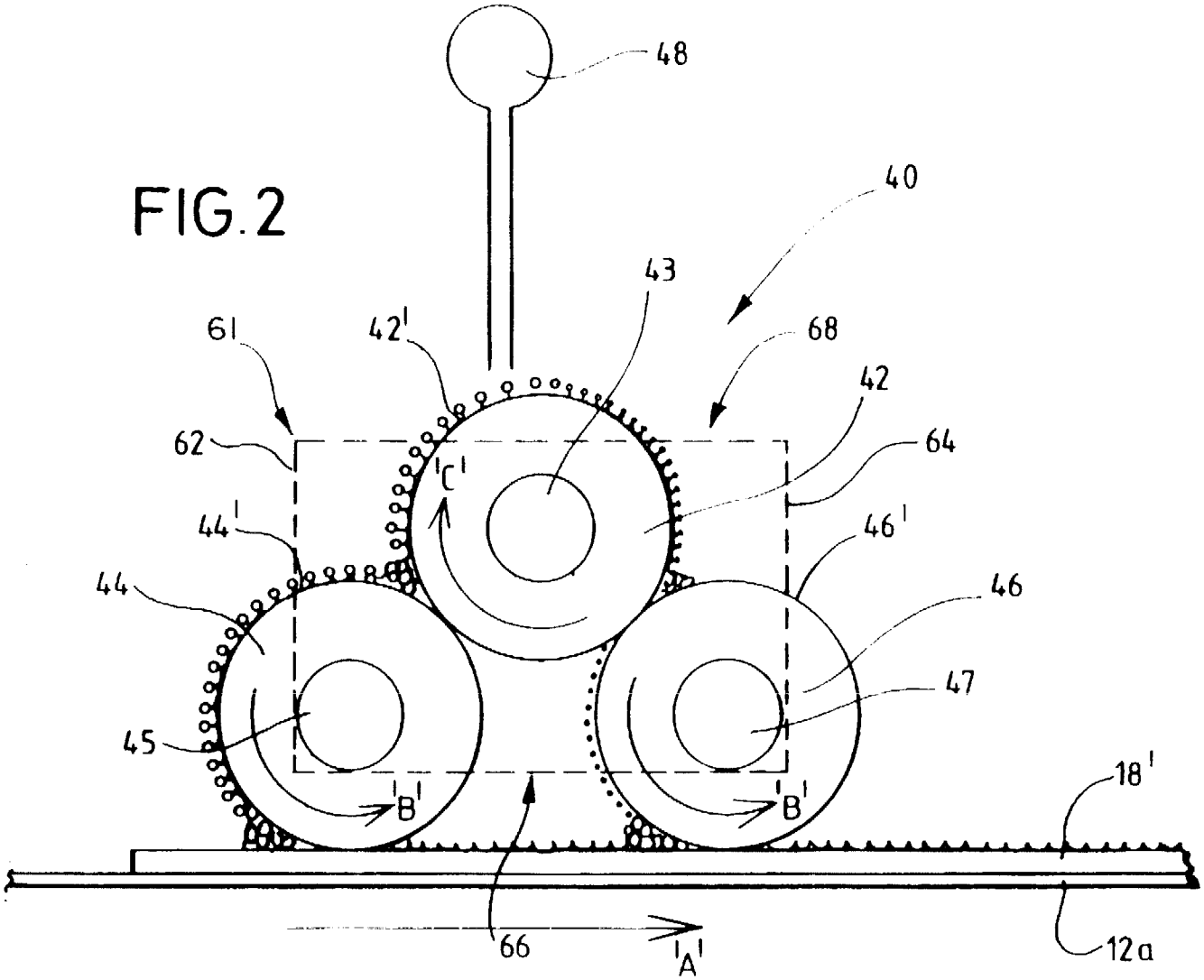
FIG. 2 is an enlarged side elevation of application rollers of the processing stage shown in FIG. 1.

FIG. 2 illustrates the operation of the applicator means 40 in more detail. A part of portion 12*a* of belt 12 is shown carrying a sheet of material 18' to be processed. Processing solution metered by the metering device 48 passes onto peripheral surface 42' of roller 42 and splits into two, one part passing down onto peripheral surface 44' of roller 44 and the other part onto peripheral surface 46' of roller 46. As shown, the metering device 48 is not aligned with the plane passing through the axis of roller 42, but it is slightly offset to one side. This enables processing solution to flow down onto roller 44 against the direction of rotation.

As the belt 12 (FIG. 1) is driven in the direction indicated by arrow 'A', rollers 44, 46 making contact therewith are caused to rotate in the direction indicated by arrows 'B'. This causes roller 42 to rotate in the direction indicated by arrow 'C'. This rotation of roller 42 directs processing solution onto roller 46 as shown.

Roller 44 provides a first application of processing solution to material 18', and roller 46 a second application. However, roller 46 may not be necessary if a second application of processing solution is not required. One such arrangement is described in more detail with reference to FIG. 3 below.

It will be appreciated that it is possible to utilize more than one further roller in each applicator arrangement to provide further applications of processing solution in a given processing stage. Naturally, a suitable roller arrangement will be required to allow the transfer of processing solution from the metering device 48.

The rollers 42, 44, 46 of the applicator arrangement 40 are not rigidly located within the apparatus. Each roller 42, 44, 46 has a respective shaft 43, 45, 47 which is of smaller diameter than its peripheral surface 42', 44', 46'. As none of the rollers 42, 44, 46 is a driven roller, each roller is retained in a simple cage 61, shown by dotted lines in FIG. 2, the weight of upper roller 42 forcing lower rollers 44, 46 apart so that shafts 45, 47 lie against wall portions 62, 64 of the cage 61.

As shown, cage 61 has a lower wall portion 66 and an upper wall portion 68. Upper wall portion 68 operates to prevent roller 42 from 'jumping' out of the cage 61 if the force applied to lower rollers 44, 46 by movement of the belt 12 is too great.

Lower wall portion 66 may be omitted provided that shafts 45, 47 of lower rollers 44, 46 are satisfactorily confined by wall portions 62, 64 so that they support upper roller 42.

Each roller 42, 44, 46 is preferably a plain, smooth, rubber-surfaced roller. However, the surface of the roller may be made of any other suitable material. The surface of the rollers may be grooved or the rollers may be gravure rollers depending on the particular application.

Figure 3:
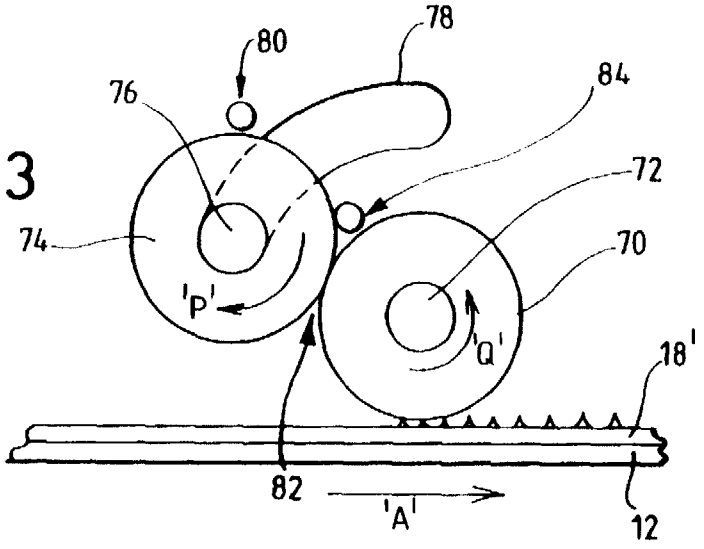
FIG. 3 is an enlarged side elevation illustrating another arrangement for the application rollers of the processing stage shown in FIG. 1.

FIG. 3 illustrates an arrangement where there is no requirement for a second application of processing solution to the material 18'. Here, a single lower roller 70 is positioned to make contact with the surface of the material 18' being processed. Shaft 72, about which roller 70 rotates, is retained in a predetermined position with respect to the material 18' by any suitable means (not shown). An upper roller 74 having a shaft 76 is located above roller 70 as described previously. Shaft 76 is confined within an arcuate slot 78, formed in a support of the apparatus (not shown), and can be retained in any position in the slot 78 by any suitable means (not shown). In FIG. 3, the shaft 76 is shown in the lowest position in slot 78.

Processing solution is applied to the surface of roller 74 by means of a spray bar 80. As before, the applied processing solution is carried on the surface of the roller 74 as it rotates in the direction shown by arrow 'P', and is transferred onto the surface of roller 70, rotating in the direction shown by arrow 'Q', where roller 74 makes contact with roller 70, indicated generally by the reference numeral 82. As before, the material 18' is carried by belt 12 in the direction indicated by arrow 'A'.

By having the upper roller 74 adjustable with respect to the lower roller 70, it is possible to control the amount of processing solution in the nip 82 between the two rollers 70, 74 more accurately.

If required, an additional spray bar 84 located adjacent nip 82 between the rollers 70, 74 for supplying additional processing solution to roller 70.

It is preferred that the spray bars 80, 84 comprise a length of tubing having an internal diameter of 3 mm, the tubing being of sufficient length to extend along the entire length of the rollers 70, 74. In this particular arrangement, the spray bars 80, 84 have four holes formed along their length, the holes having diameters of 0.5 mm.

Naturally, the length of the spray bars 80, 84, the number of holes formed therein and sizes of the holes are chosen in accordance with the viscosity of the solution which is to be applied therethrough. These variables are also dependent on the desired solution laydown, that is, the coverage of solution on the material 18'.

Figure 4:
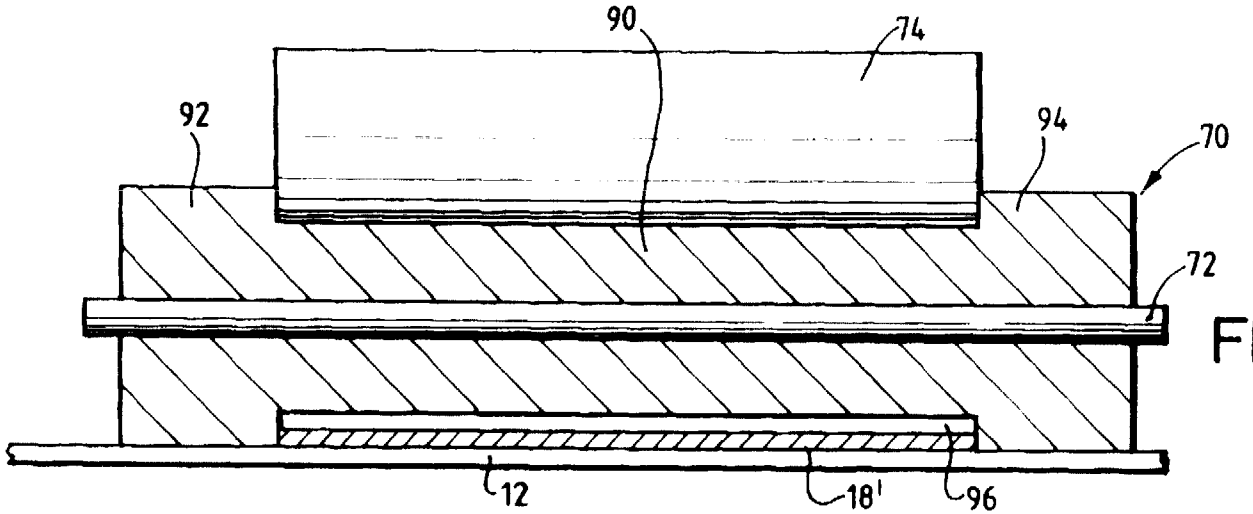
FIG. 4 is a side elevation of the application roller arrangement shown in FIG. 3.

Lower roller 70 may have a textured surface to assist in the transfer of processing solution to the material 18'. In such a case, the lower roller 70 is shaped so that it comes into closer contact with the upper roller 74. Such an arrangement is shown in FIG. 4. Parts which have been already described are referenced the same.

FIG. 4 shows a sectioned view through lower roller 70 and illustrates the shaping thereof. Roller 70 is profiled so that it has central portion 90 which has a smaller diameter than shoulder portions 92, 94 at each end. The central portion 90 has a textured surface and is of sufficient length to accommodate the material 18' being processed as it is carried by the belt 12. Upper roller 74 also rests in the central portion 90 of roller 70. As shown, central portion 90 forms a recess 96 with material 18' on belt 12 in which a bead of processing solution (not shown) can be established for coating onto the material 18'.

A shaped lower roller has the advantage that there is not direct contact between the roller and the material being processed, which reduces contamination of the processing solution and hence subsequently processed material.

Figure 5:
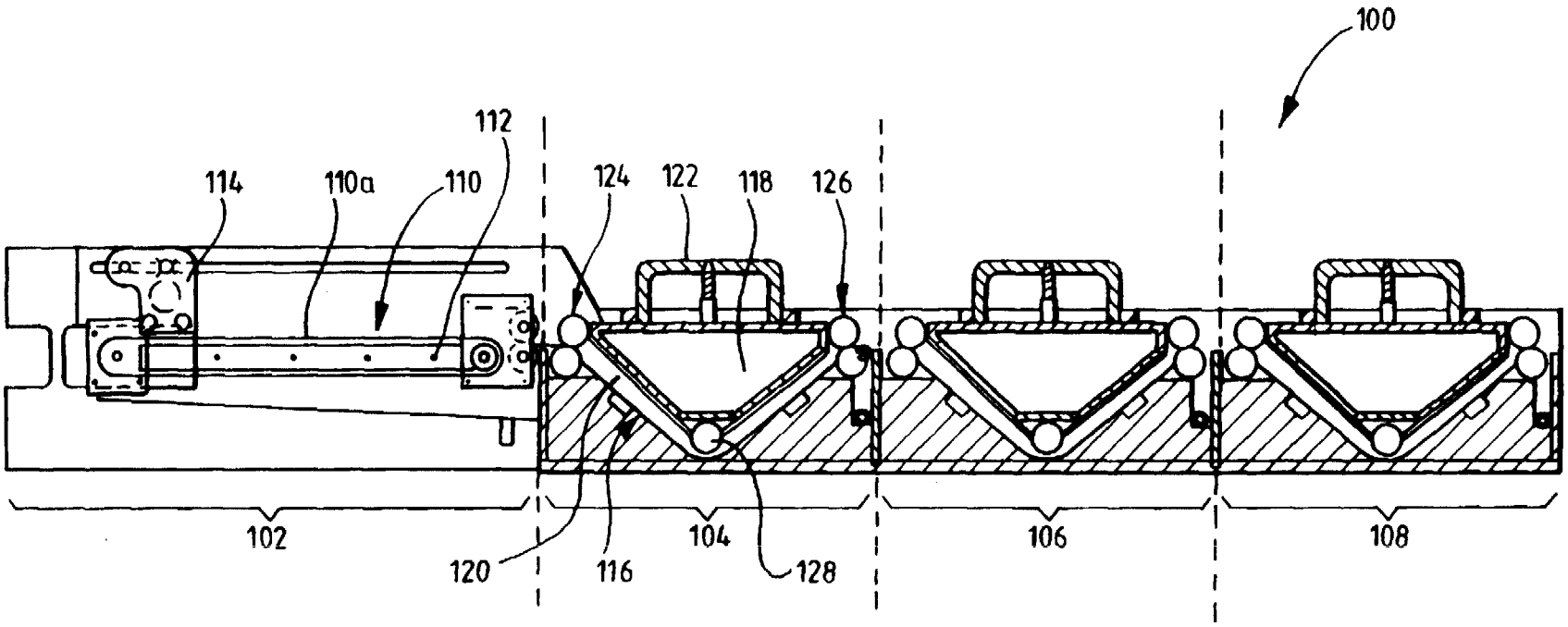
FIG. 5 illustrates processing apparatus incorporating a processing stage in accordance with the present invention.

FIG. 5 illustrates a photographic processor which incorporates a processing stage in accordance with the present invention. The processor 100 comprises a developing stage 102, a stop stage 104, a fixing stage 106 and a wash stage 108. The developing stage 102 is a processing stage in accordance with the present invention. The stop, fixing and wash stages 104, 106, 108 comprise identical components and hence only one of these stages will be described in detail. It will be appreciated that although these stages 104, 106, 108 are identical in construction, different processing solutions are used in each stage.

Developing stage 102 comprises an endless transport belt 110 on which material to be processed (not shown) is transported, the belt 110 being carried by two rollers (not shown). A heating block 112 is located between the rollers and contacts upper belt portion 110*a* (which carries the material to be processed) to transfer heat thereto. The heating block 112 may be heated by any suitable means, for example, hot water as described above with reference to FIG. 1. Located above the belt 110 is an applicator arrangement, shown generally as 114, and which comprises one of the embodiments described with reference to FIGS. 1 and 2 or FIGS. 3 and 4.

After the material has passed through the developing stage 102, it passes into the stop stage 104. This stage comprises a generally V-shaped tank 116 in which a similarly shaped heated platen 118 is located to define a processing channel 120. The platen 118 includes a handle 122 by which it can be removed from the processing stage 104. A pair of transport rollers 124 are located at the entrance to the processing channel 120 and another pair of transport rollers 126 at the exit to the processing channel 120. An additional roller 128 is also provided at the lowest point of the generally V-shaped platen for aiding the material as it passes from one part of the V-shaped tank 116 to the next.

The material then passes onto the fixing and the washing stages 106, 108 which are of identical construction to stop stage 104 as mentioned previously. After the washing stage 108, the processed material passes to a drying stage (not shown).

Standard aqueous photographic processing solutions can be applied to photographic material using the present invention. For color and black-and-white print materials solution coverage in the range of 60 $mlm^{-2}$ to 300 $mlm^{-2}$ may be applied, preferably in the range of 60 $mlm^{-2}$ to 150 $mlm^{-2}$. For black-and-white film materials, solution coverage in the range of 15 $mlm^{-2}$ to 300 $mlm^{-2}$, preferably around 20 $mlm^{-2}$. For color negative materials, solution coverage in the range of 80 $mlm^{-2}$ to 1000 $mlm^{-2}$, preferably, 600 $mlm^{-2}$ to 800 $mlm^{2}$, may be usefully provided.

Processing may be carried out in a processing stage as described above in around 8s.

It will be readily appreciated that each processing stage may carry out a different process in the processing of a photographic material, for example, one stage could be used for applying developer solution and the next for fixing solution. This minimises cross-contamination.

It may also be possible to apply individual components of processing solutions to the material being processed as it passes through the processing apparatus, for example, using redox amplification processing chemistry (RX chemistry), the developer and peroxide may be applied in the same processing stage, the developer being applied using one applicator arrangement and the peroxide by another applicator arrangement positioned downstream of the developer applicator arrangement. In such a case, each applicator arrangement would have a blade member and spring associated therewith.

Alternatively, RX developer solutions may be applied to the apparatus of the present invention in a pre-mixed form for direct application to photographic material to be processed.

A processing stage in accordance with the present invention requires minimal cleaning. Moreover, there is no need for cleaning when the processing stage is shutdown or re-started.

It will be appreciated that the material to be processed is retained against the support surface of the endless belt by means of surface tension. This may be due to the presence of the processing solution itself on the surface of the belt. Alternatively, water or another suitable inert liquid could be applied to the belt at a separate station.

If it is desired that the under surface of the photographic material being processed is not contaminated with processing solution, water may be used to hold the material against the belt. In this case, the rollers may not extend the full width of the material being processed so that no processing solution is applied near to the edges of the material.

When processing graphics arts materials, antihalation layers used to prevent reflections during exposure thereof are normally washed off in tank processors. These layers can also be removed by processing solution on the conveyor belt.

It is to be understood that various other changes and modifications may be made without departing from the scope of the present invention. The present invention being defined by the following claims.

We claim:

1. Apparatus for processing photographic material including at least one processing stage which comprises:

a support surface for supporting the material being processed;

transport means for transporting the material through the processing stage; and application means for applying processing solution to the material while the material is in the processing stage, the application means comprising at least two roller members arranged above the support surface, an upper roller member of said at least two roller members being located above a lower roller member of said at least two roller members and in contact therewith;

wherein the application means further includes metering means for supplying processing solution in predetermined amounts to at least one roller member of said at least two roller members thereof; and the at least two roller members are freely mounted for rotation, the lower roller member being in contact with the support surface, at least in the absence of material to be processed, each of the at least two roller members being rotated by contact with the support surface and/or movement of the photographic material through the processing stage.

2. Apparatus according to claim 1, wherein the transport means comprises an endless belt supported by and between two rollers located in a substantially horizontal plane, the belt having an outer and an inner surface.

3. Apparatus according to claim 2, wherein the support surface comprises an outer surface of the endless belt.

4. Apparatus according to claim 1, further including wiper means adjacent the application means for holding the material in even contact with the endless belt and for providing agitation of processing solution on the surface of the material.

5. Apparatus according to claim 4, wherein the wiper means comprises a blade member or wiper membrane which is held at one end against an outer surface of the endless belt by a spring element, rotation of the endless belt drawing the blade member or wiper membrane out substantially horizontally.

6. Apparatus according to claim 1, wherein the lower roller member has a textured surface over a central portion of the lower roller member, the central portion having a smaller diameter than shoulder portions of the lower roller member to form a recess in which a bead of processing solution can be established for application to the material being processed, the material passing between the shoulder portions of the lower roller member, and wherein the upper roller member makes contact with the textured central portion of the lower roller member.

7. Apparatus according to claim 1, further including collection means for collecting any excess processing solution applied to the photographic material.

8. Apparatus according to claim 2, further including a heating block located between the rollers associated with the endless belt, the endless belt making contact with the heating block in regions between the rollers of the endless belt.

9. Apparatus according to claim 1, further including an inlet through which photographic material is introduced into the processing stage, the inlet comprising a pair of driven nip rollers.

10. Apparatus according to claim 1, wherein the processing solution comprises redox amplification (RX) chemistry.

* * * * *